US005414974A

United States Patent [19]

Van de Ven et al.

[11] Patent Number: 5,414,974

[45] Date of Patent: May 16, 1995

[54] AUTOMATED DOCUMENT HANDLING SYSTEM

[75] Inventors: John Van de Ven; Frederick J. Facklam; Franklin L. Burket, all of Grand Island, N.Y.

[73] Assignee: Moore Business Forms, Inc., Grand Island, N.Y.

[21] Appl. No.: 107,078

[22] Filed: Aug. 17, 1993

[51] Int. Cl.[6] ..... B65B 13/02; B65B 57/00

[52] U.S. Cl. ..... 53/399; 53/55; 53/168

[58] Field of Search ..... 53/168, 154, 174, 237, 53/240, 55, 505, 399, 411, 445, 449, 54, 155, 156

[56] References Cited

U.S. PATENT DOCUMENTS

| | | | |
|---|---|---|---|
| 3,043,069 | 7/1962 | Whitehouse et al. | 53/174 |
| 4,007,866 | 2/1977 | Traise . | |
| 4,397,384 | 8/1983 | Nohren . | |
| 4,428,179 | 1/1984 | Jordan et al. | 53/154 X |
| 4,433,426 | 2/1984 | Forster . | |
| 4,495,582 | 1/1985 | Dessert et al. . | |
| 4,505,092 | 3/1985 | Bowers et al. | 53/168 X |
| 4,517,650 | 5/1985 | Gomes et al. . | |
| 4,525,788 | 6/1985 | Gottlieb et al. . | |
| 4,527,468 | 7/1985 | Piotroski . | |
| 4,527,790 | 7/1985 | Piotroski . | |
| 4,541,763 | 9/1985 | Chandhoke et al. | 52/156 X |
| 4,585,220 | 4/1986 | Zemke et al. . | |
| 4,627,219 | 12/1986 | Omori | 53/449 X |
| 4,648,540 | 3/1987 | Steidel . | |
| 4,716,711 | 1/1988 | Signoretto | 53/168 |
| 4,805,111 | 2/1989 | Steidel . | |
| 4,839,814 | 6/1989 | Steidel . | |
| 4,847,775 | 7/1989 | Roch et al. . | |
| 4,870,799 | 10/1989 | Bergerioux et al. | 53/168 X |
| 4,898,094 | 2/1990 | Doumoto et al. . | |
| 4,944,033 | 7/1990 | Erni . | |
| 4,962,623 | 10/1990 | Francisco | 53/54 |
| 5,028,040 | 7/1991 | Kalisiak . | |
| 5,052,296 | 10/1991 | Shiba . | |
| 5,067,305 | 11/1991 | Baker et al. | 53/54 X |
| 5,150,302 | 9/1992 | Adachi et al. . | |
| 5,220,770 | 6/1993 | Szewczyk et al. | 53/168 X |

FOREIGN PATENT DOCUMENTS

| | | | |
|---|---|---|---|
| 3317087 | 11/1984 | Germany | 53/505 |

*Primary Examiner*—Linda B. Johnson
*Attorney, Agent, or Firm*—Nixon & Vanderhye

[57] ABSTRACT

Documents printed by high speed laser printers are automatically handled to verify, track, handle, and deposit them in appropriate shipping containers. The system is modular so that it can be configured to suit the needs of a wide variety of users, and includes document transport conveyors, transfer conveyors, and container transport conveyors. A paper sheet having bar coding is associated with each group of documents and the bar coding is sensed to determine where to route the document (what shipping container it should be placed in), and also optionally other document handling procedures, such as plastic shrink wrapping and/or banding. Documents are conveyed to a number of different filling stations with containers passing underneath the filling stations. When the destination bar coding on a group of documents at a filling station matches the bar coding on the container underneath that filling station, dump paddles are activated to drop the group of documents into the container. Prior to operation of the dump paddles, the size of the group of documents and the remaining volume in the container are both sensed to be sure the group of documents will fit in the container. Containers that are determined to be full are transferred to a shipping loop for transportation by trucks or other shipping options.

51 Claims, 8 Drawing Sheets

FROM 76
BLG
72
IDS
35
TC6,7
43, 44
FBTC
78
DPC1
59
DPC2
TATC
82
BFS
77
SS1
64
SS2
64
FSBDS
70
TAS
81
PC
D1
76
TO 72
D2
76
SSC2
71
STTC
28
15
SSC1
71
FSDDS
63
FSDDS
63
STS
26
TBCC
33
FSS1
37
FSS4
37
FSTC1
38
FSTC4
38

AUTOMATED DOCUMENT HANDLING SYSTEM

BACKGROUND AND SUMMARY OF THE INVENTION

High speed laser printers allow a company the ability to produce large numbers of documents quickly. While a number of systems have been developed, for both pre- and post-processing of documents associated with laser printers, one area which has not been sufficiently addressed is to how to handle all the documents after they have been produced. Present methods are either completely manual and very labor intensive, also having a significant number of errors associated therewith, or are "rigid", being centrally controlled so that every time a change or modification is necessary new software must be developed and implemented.

In the handling of documents from laser printers, it is often necessary to wrap or band the documents into groups, then route them to particular shipping containers which have different destinations. The method and apparatus according to the present invention allows all of the steps associated with handling of the documents after printing by a laser printer to be automatic, including ensuring that each group of documents is selectively handled in the manner best for it, and is routed to an appropriate shipping container.

In one logical sequence of operation of the apparatus according to the invention to practice the method according to the invention the documents are printed on a laser printer, and bar codes are printed on the banner page for each group of documents for the same destination. If the documents are in continuous form (rather than cut sheet form), they are folded, severed, and stacked with the banner page down. The documents then move past a bar code scanner onto a staging conveyor where the documents are scanned for verification and to enter them into a data base. For example the first five digits of the bar code may provide a consecutive number printed by the printer with a sequence from each printer to identify the particular printer. A scanner decoder monitors the consecutive order of the numbers to verify that all the documents are in sequence and none are missing. If an out of sequence document is detected an alarm may be sounded, the stacker can be stopped, or the group of documents can be moved onto a special handling conveyor. The documents are moved onto a main line conveyor at a merging intersection when sensors detect the absence of other documents in, or immediately before, the intersection.

The main line conveyor may convey the documents at about 100 feet per minute allowing enough space between documents to handle the output from at least three printers. Documents are sensed and scanned for diversion to wrapping, or other finishing lines. Also information can be used to produce a label for a shipping container if the document is the first for a particular new delivery point, so that a new container can be labelled. For example if the sixth character in the bar code on the banner page is a "0" the group of documents may continue down the main line, whereas if it is a "1" a signal from a decoder will activate an intersection (transfer conveyor) to divert the document to a continuous loop wrapping line. The documents are merged from the wrapping line back into the main line.

As the documents move along the main line conveyor they come to filling station intersections (transfer conveyors). If a sensor in a filling station determines that it is empty, an intersection will be activated and a document diverted over a scanner into the filling station For example characters 7 to 10 of the bar coding of the banner page may contain the destination code which is scanned and stored in a decoder until a shipping container with the same destination code is scanned. When the two codes match the document is dropped into the shipping container, which is being conveyed on a shipping container conveyor beneath the filling station. The drop is inhibited if sensors determine that the shipping container does not have enough room for the document in the filling station.

If there is a document in a filling station that does not fit any shipping container a new container with the same destination code may be put into the container conveying loop. If the first station is full the document continues along the main line until it finds an open station, or if no stations are open, it transfers in an auxiliary loop to be fed back to the main line conveyor before the first filling station.

If a container in the shipping container loop is detected as full it is diverted out of the shipping container loop onto a storage conveyor, and a new container for that shipping point (particular destination bar coding) is put into the container loop. When a delivery truck arrives, delivery codes for that truck are entered into the system, and all containers with delivery codes entered for that truck are diverted from the active and storage conveyors to the truck. The shipping containers may be scanned as they are loaded for inventory purposes.

The apparatus according to the present invention is not limited by having a fixed central intelligence gathering area which must be continuously modified. Instead the system of the invention has a number of infinitely variable modules, each with some level of intelligence which is able to communicate with other modules. While a controller is utilized for recording data or interfacing various operations, it is not the primary control for the line functions, but rather the line functions are controlled at each individual station.

According to one aspect of the present invention apparatus for handling stacks of documents is provided. The apparatus comprises the following elements: A plurality of individual modules, each module having intelligence associated therewith, and self-contained control means associated therewith. Document conveying means extending between the modules and for moving documents into association with, or into and out of association with, the modules. A plurality of sensing means for sensing the position, type, or size of stacks of documents being conveyed by the conveying means, at least one sensing means associated with each of the modules. And, a plurality of open top containers each for containing (and capable of containing) a plurality of stacks of documents for a common destination. A container conveyor means for conveying the containers in a closed loop may also be provided, and one of the modules comprises a container filing module located above the container conveying means for selectively dropping a stack of documents into a container. Other modules may include a fold, sever, stack and merger module, a special handling module for removing special document groups from the main line conveyor; a wrapping module and/or a banding module (provided together or independently); auxiliary transfer conveyor modules; and the like.

According to another aspect of the present invention apparatus for handling groups of documents is provided comprising the following elements: First linear document conveying means for conveying documents in a first predetermined path. First auxiliary document conveyor means connected to the first linear conveying means by transfer conveyors, and defining a closed loop beginning and ending in the first linear conveying means. Second auxiliary document conveyor means connected to the first linear conveying downstream of the first auxiliary conveyor means in the first path, and defining a closed loop beginning and ending in the first linear conveying means. First container filling means connected to the first linear conveyor means by a transfer conveyor. First container conveying means defining a conveying loop path beneath the filling means. And, automatic sensing means for sensing documents at the first container filling means and a container beneath the first container filling means and selectively operating the first container filling means to deposit documents from the filling means into a container on the first container conveying means.

The automatic sensing means may include means for sensing the size of a group of documents at the first filling means, and means for determining the remaining volume of the container beneath the first filling means. A plurality of container filling means preferably are provided disposed above the first container conveying means. Second sensors sense documents on the first linear document conveying means upstream of the first auxiliary conveying means, and selectively pass the documents to the first auxiliary conveying means. Another automatic sensing means senses when a group of documents is at the first filling station and selectively passes the group of documents to the first filling station if it is unoccupied. A second container conveying means remote from the filling means, and a transfer conveyor connecting the first and second container conveying means, also are provided, as well as a further sensor for sensing the fullness of the containers on the first container conveying means and selectively controlling the transfer conveyor between the first and second container conveyor means.

The apparatus also comprises a system for automatically handling groups of documents, including the following elements: Means for printing a plurality of documents. Means for grouping the printed documents into a plurality of different groups. First conveying means for conveying grouped documents away from the printing means. Means for verifying the correctness of the groups of documents. A special document group location. Means for selectively diverting groups of documents from the first conveying means to the special document group location in response to the verifying means. And, means for selectively acting on the groups of documents conveyed by the first conveying means to maintain the integrity of the groups in bundles.

According to another aspect of the present invention apparatus for handling stacks of documents comprises: A plurality of transport conveyors for conveying documents in stacks thereon, and disposed in at least one continuous loop configuration so that there are intersections between at least some of the transport conveyors. A plurality of transfer conveyors located at the intersections between the transport conveyors for selectively transferring stacks of documents from one transport conveyor to an intersecting transport conveyor. First automatic sensing means for sensing the stacks of documents, and in response to the sensing selectively controlling the transfer conveyors. Container conveying means for conveying a plurality of containers adapted to be receive said stacks of documents. Automatic filling means for depositing selected stacks of documents in selected containers. And, second automatic sensing means for sensing the containers, and in response to sensing the containers and to the first automatic sensing means, selectively operating the filling means to deposit selected stacks of documents in selected containers.

The containers are typically open topped and the automatic filling means comprises a movable document support surface, such as a pair of dump paddles separately mounted for rotation about an axis parallel to and horizontally spaced from the axis of the other of the dump paddles. The dump paddles are disposed over the container conveyor means which are at a second vertical level below the first level a distance corresponding to at least the height of the container. Means are provided for controlling the movable document support surface to effect movement so that it no longer supports a stack of documents so that the stack of documents drops into an open top container. A plurality of filling means are provided each comprising a pair of dump paddles with independent control means for operating the dump paddles of each filling means.

The transfer conveyors can comprise a plurality of driven rollers parallel to each other and located adjacent one another and rotatable about an axis substantially perpendicular to the direction of conveyance of the rollers, and a plurality of endless conveyor belts are disposed over the rollers and elongated in the direction of conveyance. The apparatus further comprises means for acting on the stacks of documents for placing them in integral bundles and third automatic sensing means for sensing which bundles will be acted upon in what particular manners. The acting means may comprise plastic shrink wrapping means and/or banding means. The third sensing means may include means for sensing a thickness of a stack to be acted upon and depending upon the thickness selectively placing a stiff sheet into contact with the top or bottom of the stack (e.g. if the stack has a thickness of less than one inch). There also may be the sensing means downstream of the shrink wrapper for selectively directing the bundle to banding means depending upon the sensed thickness (e.g. if greater than one and one-half inches bands or straps are provided in two perpendicular directions around the bundles). Each stack of documents in each container preferably has destination bar coding associated therewith, and the first and second automatic sensing means each comprise bar code sensing means. There also may be provided means for generating a bar code label with the same destination bar coding thereon as a removable container so that the label can be applied to a new emptier container which replaces the full container.

The invention also relates to a method of automatically creating and sorting document groups for automatic delivery to a plurality of different destinations, using a plurality of different containers with machine readable destination codes. The method comprises the steps of substantially continuously and automatically: (a) Automatically creating a plurality of different groups of documents, each group having from one to many documents. (b) Automatically creating machine readable indicia for association with each of the groups of documents, the indicia including at least destination indicia. (c) Automatically associating the machine readable indicia with each group of documents. (d) Automatically diverting one of the groups of documents to a first filling station. (e) Automatically sensing the machine readable destination indicia associated with the groups of documents at the first filling station. (f) Automatically passing the plurality of containers with machine readable destination codes past the first filling station. (g) Automatically sensing the machine readable destination codes of the containers as they move past the first filling station. And, (h) when the sensed destination indicia of a group of documents at the first filling station matches the destination code of a container passing past the first filling station, automatically transferring the group of documents from the first filling station to the matched container.

There may also be the further step (i) of determining the size of the group of documents at the first filling station and the volume remaining in the matched container, and step (h) may be practiced only if the determination from step (i) indicates sufficient remaining volume in the matched container to receive the group of documents at the first filling station. There may also be the further step (j) of providing for passage in step (f) of a new matched container for the group of documents at the first filling station if it is determined in step (i) that the matched container has insufficient volume remaining.

Typically a plurality of different filling stations are provided, and step (f) is practiced to continuously recirculate the containers past all of the filling stations, and step (d) is practiced for each filling station in response to sensing of the availability of each filling station to receive a group of documents.

There may alternatively, or in addition, be the further steps, between steps (c) and (d), of (i) verifying that each group of documents is a proper group of documents, and (j) if in response to step (i) it is determined that the group is not a proper group, diverting the improper group to an improper group location so that it does not pass to step (d). Step (i) is practiced to verify that the appropriate number and type of documents are in a group and to verify that the group does not contain more than a predetermined number of documents (e.g. 500), which require special handling. Step (b) is typically practiced by printing a sheet of paper associated with each group of documents with a bar code, and the machine readable codes associated with each container are also bar codes.

The method may also comprise the further steps of (i) automatically sensing the absence or presence of a group of documents at the first filling station, practicing step (d) if no other group of documents is sensed at the first filling station, and (j) if step (i) senses another group of documents at the first filling station, causing the group of documents to move past the first filling station in a closed loop path until the first filling station is open as sensed during the practice of step (i).

According to another aspect of the present invention a method of automatically handling groups of documents is provided, comprising the steps of automatically and subsequentially: (a) Continuously printing a plurality of documents. (b) Grouping the printed documents into a plurality of different groups. (c) Verifying the correctness of the group of documents. (d) If in response to step (c) a group of documents is determined to be incorrect for further processing, diverting the document to an incorrect document group location. (e) If in response to step (c) a group of documents is determined to be correct for further processing, determining the thickness of the group of documents. (f) If in response to step (e) a document is determined to have a thickness less than a predetermined amount, placing a stiff sheet on the group of documents. And, (g) wrapping each group of documents into a bundle.

The method may also comprise the further steps of automatically and substantially sequentially: (h) Sensing the thickness of each bundle of documents, and (i) if in response to step (h) it is determined that the thickness of the bundle is greater than a predetermined amount, banding the bundle. Step (i) is practiced to band the bundle by fastening bands or straps around it in two different, substantially perpendicular directions.

According to still another aspect of the invention a method of routing a plurality of stacks of documents to desired destinations, at least two groups of documents being routed to each of at least two different destinations, is provided. The method comprises the steps of: (a) Providing a paper sheet having bar coding thereon with destination indicia at at least the top or the bottom of each of the plurality of stacks of documents. (b) Automatically sensing the destination bar coding on each stack of documents. (c) Automatically sensing destination bar coding associated with a container large enough to receive a plurality of stacks of documents. And, (d) automatically in response to steps (b) and (c), depositing a plurality of stacks of documents having the same destination bar coding in a matched bar code container.

There may also be the further steps of (e) automatically sensing when each container has more than a predetermined amount of documents therein so that the remaining volume in the container is less than the size of the next expected stack of documents, indicating that the container is full, and (f) automatically replacing the full container with an emptier container having the same destination bar coding. There may also be the further step of (g) substantially continuously moving the stacks of documents and containers while practicing steps (b) and (c), to allow random matching of the stacks with the containers. There may also be the step (h), prior to step (d), of acting on the stack of documents so that it maintains its integrity during the practice of steps (a)-(d), and so that at least a plurality of the stacks can be easily removed from the container, distinctly from the other stacks in the container. Step (h) may be practiced by banding, plastic shrink wrapping, or both, at least some stacks. Step (a) may be practiced to provide handling bar code indicia on the paper sheet with the destination bar code indicia, in which case there are the further steps of automatically sensing the handling bar code indicia on the paper sheet and practicing step (h) in response to that sensing.

It is the primary object of the present invention to provide for the efficient automatic handling of documents from a laser printer. This and other objects of the invention will become clear from an inspection of the detailed description of the invention and from the appended claims.

DETAILED DESCRIPTION OF THE DRAWINGS

Figure 1:
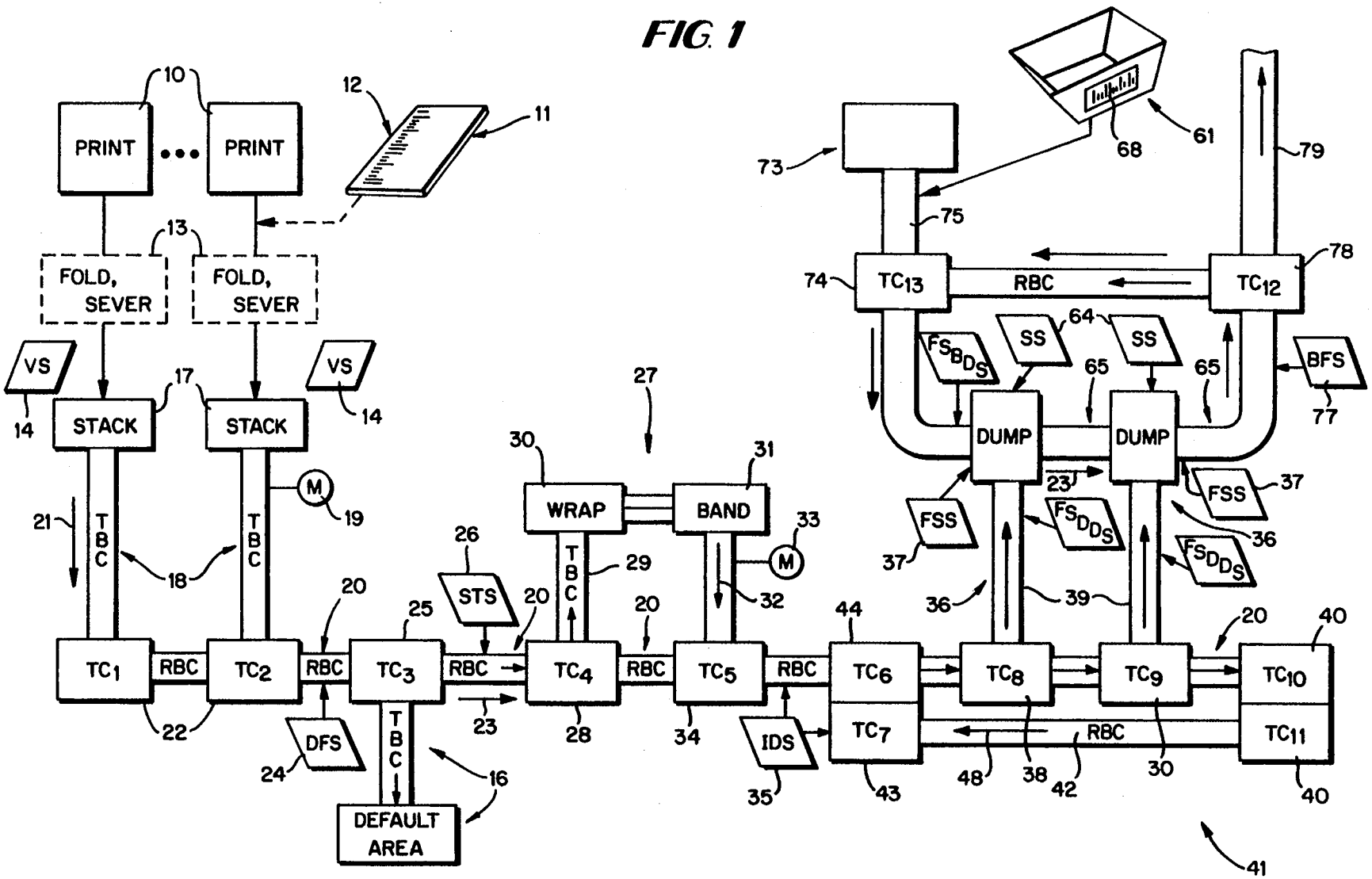
FIG. 1 is a schematic view of exemplary apparatus according to the present invention for practicing exemplary methods according to the present invention.

The apparatus according to the invention illustrated in FIG. 1 includes one or more printers 10, preferably laser printers such as a Xerox model 4135 laser printer equipped with a by-pass transport finishing feature. Such a printer is capable of 24 hour a day operation, and has an output capacity of 135 8½ inch×11 inch pages per minute printed face down and delivered in landscape orientation. According to the invention, the sheets from the printer 10 will be gathered into document groups or packages having between one and a large number of sheets, e.g. typically between about four and 500 sheets. Document groups with over 500 sheets are normally handled specially.

Figure 2:
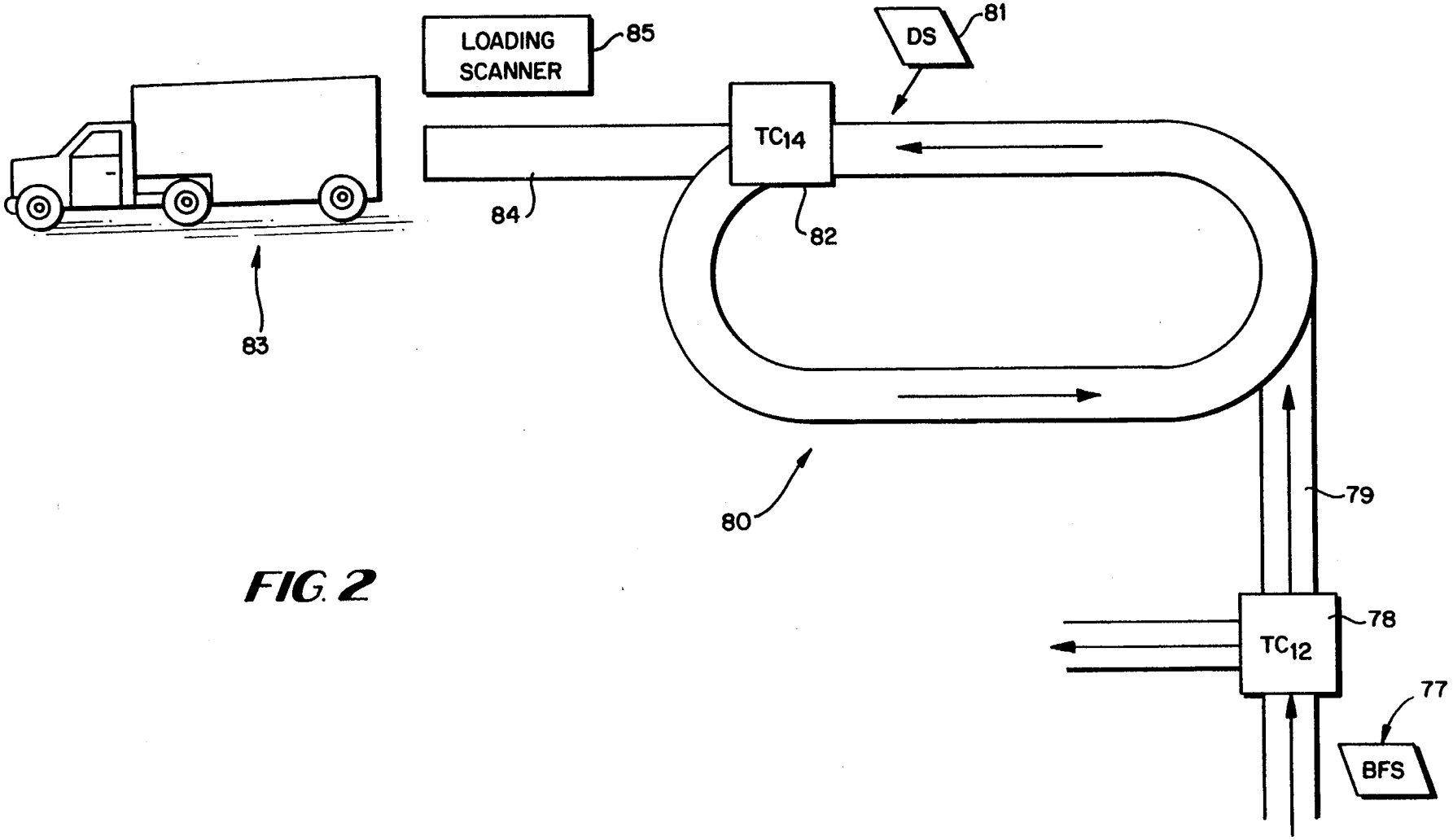
FIG. 2 is a schematic view of a full document container storage and truck-loading apparatus utilizable with the apparatus of FIG. 1.
Figure 3:
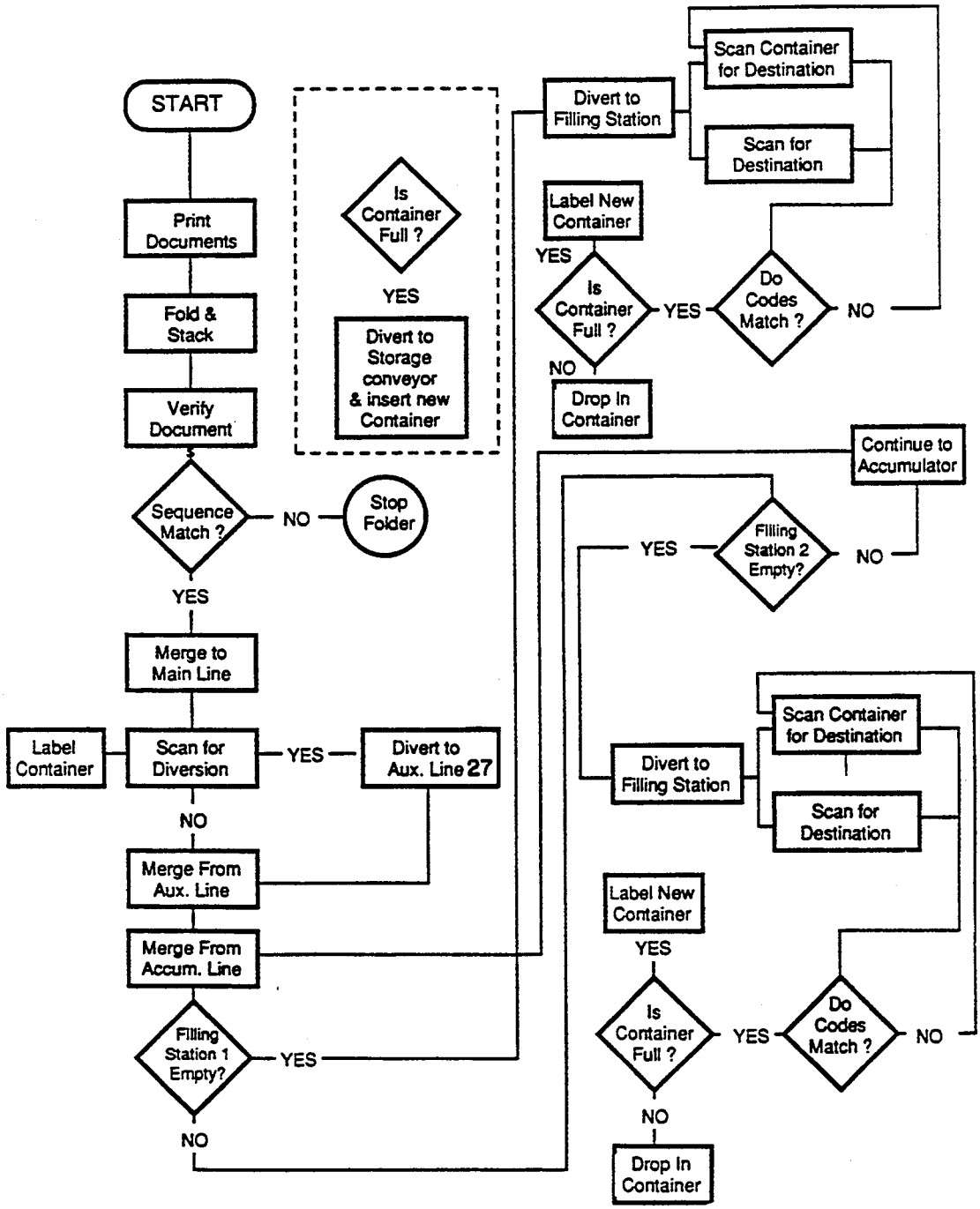
FIG. 3 is a high level control schematic illustrating operation of the apparatus of FIG. 1.

FIG. 3 schematically illustrates the control operation for the apparatus of FIGS. 1, 2, and 4 through 6 for continuous form documents. FIG. 3 is self-explanatory, showing the particular control and decision boxes, and the operations associated therewith, with clarity.

During printing with printers 10, for each group a cover or banner page 11 is printed having machine readable indicia 12 thereon. Preferably the indicia 12 is bar coding, such as a code three of nine bar code printed one and one quarter inch high and up to three inches in length in a "picket fence" orientation. A manifest page is also preferably printed. The bar coding 12 includes identification information, and destination indicia, and also may include special handling indicia or other data that is used to subsequently control exactly how the group or stack of documents with which the banner page 11 is associated or handled.

If the printers 10 print the documents in continuous form, then it is necessary to fold and sever the continuous form to produce individual sheets, and for that purpose the conventional folding and severing apparatus 13 may be utilized. Any conventional apparatus may be utilized for this purpose, such as a Suka Job Speed available from Web Converting Equipment N.V., St-Niklaas Belgium.

After folding and severing at station 13, preferably the documents are scanned with a verification scanner 14, which may comprise a moving beam laser scanner, sheet sensor, decoder, power supply and control panel. The scanner 14 scans the bar codes on the cover page 11 and the manifest pages. The decoder includes the page count from the sheet sensor with the rest of the information in the bar codes on the cover sheet 11 and manifest pages, and transmits this information to a PC which acts as a controller and data gatherer. The PC is shown generally by reference numeral 15 in FIG. 4. The verification scanner 14 verifies that the information in the bar codes 12 on the cover page 11, etc. match, and initiates diversion of any packages that do not match to a downstream special handling or default conveyor 16.

Preferably, just downstream of the verification scanners 14 are the gathering modules or stackers 17 which gather all of the sheets from the printer 10 within a particular group into a stack or package e.g. ranging from four to 500 sheets. Each package or stack will have the cover page 11 on the bottom, face down, and the manifest page on the top, also face down. If the sheet count of any package exceeds a predetermined amount (e.g. 500) it will be delivered from the gathering module 17 in stacks of 500 and prepared for diversion to the special handling conveyor/default area 16.

From the gathering module 17 the groups of documents, with banner page 11, are transported by conveyors 18, e.g. controlled by motors 19, to a main conveyor line which is shown generally by reference numeral 20 in FIG. 1. The conveyors 18 may be of any suitable type, but preferably comprise a plurality (e.g. three) of spaced conveyor belts passing over a table support surface, and conveying the groups of documents in the direction 21 to the transfer conveyors 22.

The first transfer conveyor 22 may comprise merely a right angle conveyor for conveying documents moving in one direction to a perpendicular direction, which are readily commercial available. The second and any subsequent transfer conveyors 22 typically have a conventional construction, e.g.: a conveyor having rollers or like conveying elements which normally convey groups of documents thereon in the direction 23, but which contain perpendicularly disposed, powered conveyor elements (e.g. small rollers) which may be moved upwardly between the normally operating rollers to convey a carton thereon. Conventional proximity sensors may be associated with each of the subsequent transfer conveyors 22 cooperating with a control motor 19 for the conveyor 18 associated therewith for ensuring that a group of documents does not move onto the main line 20 via the transfer conveyor 22 unless the main conveyor line 20 is ready to receive it.

Figure 4:
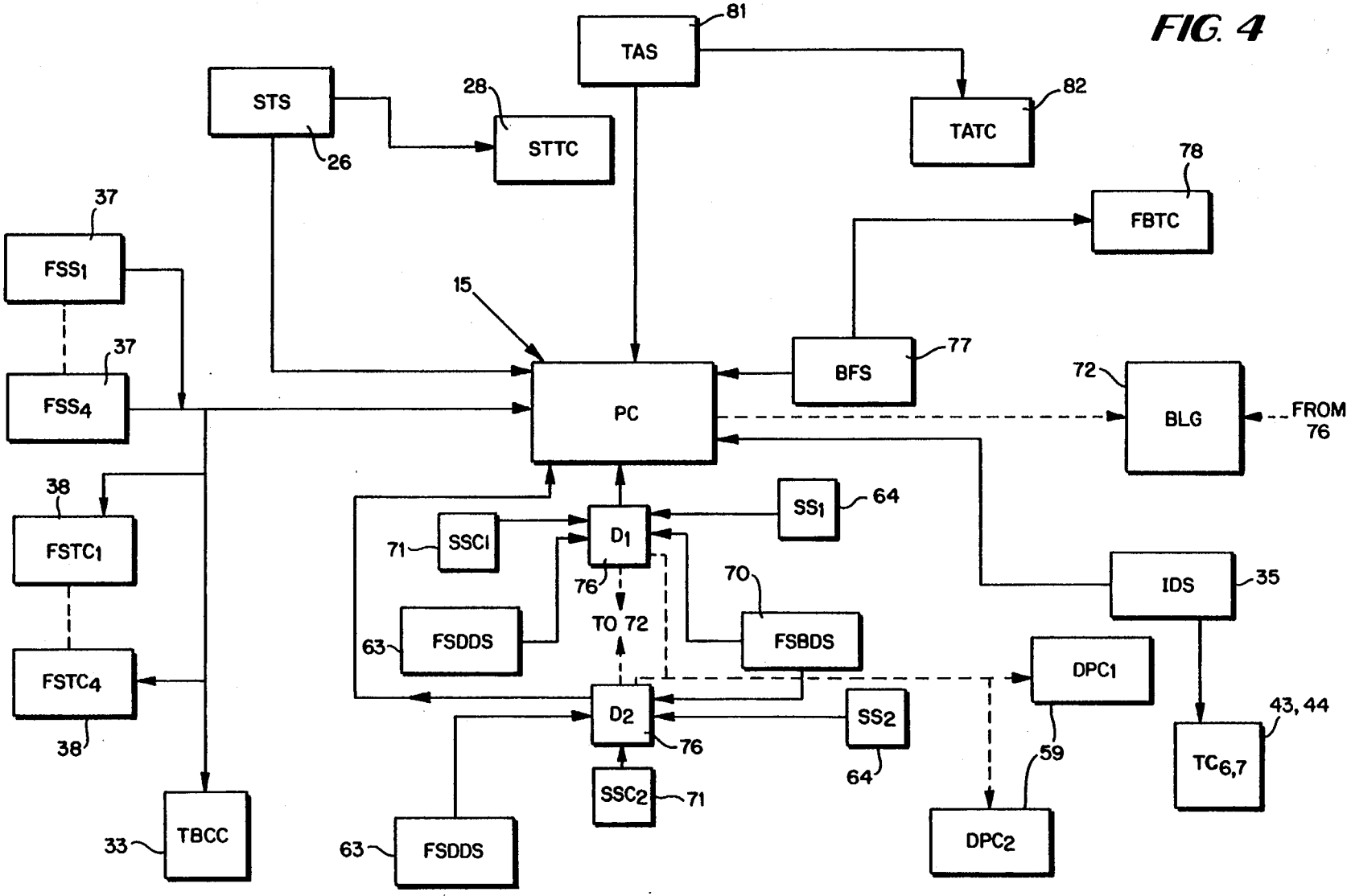
FIG. 4 is a schematic showing interconnection between various components used to control the apparatus of FIGS. 1 and 2.

In FIGS. 1, 2, and 4, symbols are used in a number of boxes. Those symbols are designed to represent the following:

DFS—Default scanner
VS—Verification scanner
TC—Transfer conveyor
RBC—Roller/belt conveyor
TBC—Table/belt conveyor
LS—Loading scanner
TBCC—Table belt conveyor controller
IDS—Initial destination scanner
TAS—Truck available scanner
TATC—Truck available transfer conveyor
FBTC—Full box transfer conveyor
BFS—Box full sensor
BLG—Box label generator
D—Decoder
STS—Selective treatment scanner (document bar code)
STTC—Selective treatment transfer conveyor
FSS—Filling station condition sensor
FSTC—Filling station condition transfer conveyor
FSDDS—Filling station document destination scanner (document bar code)

FSBDS—Filling station box destination scanner
DPC—Dump paddle control
SS—Size sensor/documents
SSC—Size sensor/container The main conveyor line 20 preferably comprises a roller/belt conveyor. That is it includes conventional rollers rotatable about axes parallel to each other and perpendicular to the direction of conveyance 23, and powered, but with a plurality of spaced conveyor belts over them. Such an arrangement provides the benefits of roller conveyors, such as speed and adaptability, but avoids the problem of conventional roller conveyors in transporting stacks of documents, since conventional roller conveyors tend to deshingle the documents from a stack. The conveyor 20 may travel at relatively high speed, e.g. at 100 feet per minute, which allows enough space between document groups to handle the output from at least three printers 10. Preferably there is provided a default scanner 24 before the default area 16 associated with the main line conveyor 20. The scanner 24 cooperates the verification scanner 14 to sense when special groups or packages arrive, such as groups which have more than the predetermined number of sheets (e.g. 500, which may divided up into more than one group because of the limitations of the gathering module 17), or the reject groups, e.g. those not having the correct number of pages, the correct pages, or other missing data. The default scanner 24 operates to control the transfer conveyor 25 which diverts the default document groups to the default area 16.

Just downstream of the default area 16 on the main line 20 is a selective treatment scanner 26, which is a conventional bar code scanner. This scans the bar coding 12 to determine whether the group of documents associated with that particular banner page 11 is to receive special treatment in the special treatment loop/apparatus 27. If it is to receive special treatment, the transfer conveyor 28 is activated to transport that group of documents over the table/belt conveyor 29 to means for acting on the group of documents to maintain them in an integral bundle or package. Such means may, for example, comprise conventional wrapping means, such as plastic shrink wrap equipment, shown schematically at 30 in FIG. 1, and/or banding equipment 31, for applying bands or straps to the groups or bundled documents. The sensor 26 will determine if one or both of the machines 30, 31 will operate on that particular group of documents.

After the documents have been specially treated in loop 27, they are conveyed by transfer/belt conveyor 32, controlled by motor 33, to the transfer conveyor 34, back into the main document conveying line 20. Appropriate conventional sensors and scanners may be associated with the conveyor 32 for ensuring that the motor 33 and transfer conveyor 34 are not operable to move a bundle or package from the loop 27 back onto the main line 20 unless there is an open space for it.

Downstream of the loop 27 in the direction 23 is an initial destination scanner 35, such as one available from Microscan of Seattle, Wash., e.g. model 520. The documents then continue to move in direction 23 to at least one and preferably a plurality of filling stations 36. Only two filling stations 36 are illustrated in FIG. 1 but it is to be understood that typically there would be a number of filling stations, e.g. four-ten, although any number can be provided.

Associated with each filling station 36 is a filling station condition sensor 37, such as an electric eye (e.g. model MCS 655AC-17 from Warner Electronics of Marengo, Ill.), which determines whether or not there is a group of documents already at that filling station 36. If there is not, then when the next group of documents, scanned by scanner 35, reaches the transfer conveyor 38 associated with the open filling station 36, the transfer conveyor 38 is operated to feed the group of documents along conveyor 39 to the open filling station 36. If all of the filling stations 36 are filled, as determined by the sensors 37, then a document group will keep moving in the direction 23 until it reaches the end of the main conveyor 20 at which position conventional transfer conveyors 40 are located, which recirculate the document groups in an auxiliary loop 41, over the roller/belt conveyor 42, to the transfer conveyors 43, 44. The transfer conveyors 43, 44 are operated by appropriate sensors to move the recirculated group of documents back onto the main line 20 when there is an open space along the conveyor 20. The scanner 35 typically cooperates with the documents being transferred by the conveyors 43, 44 too.

Figure 5:
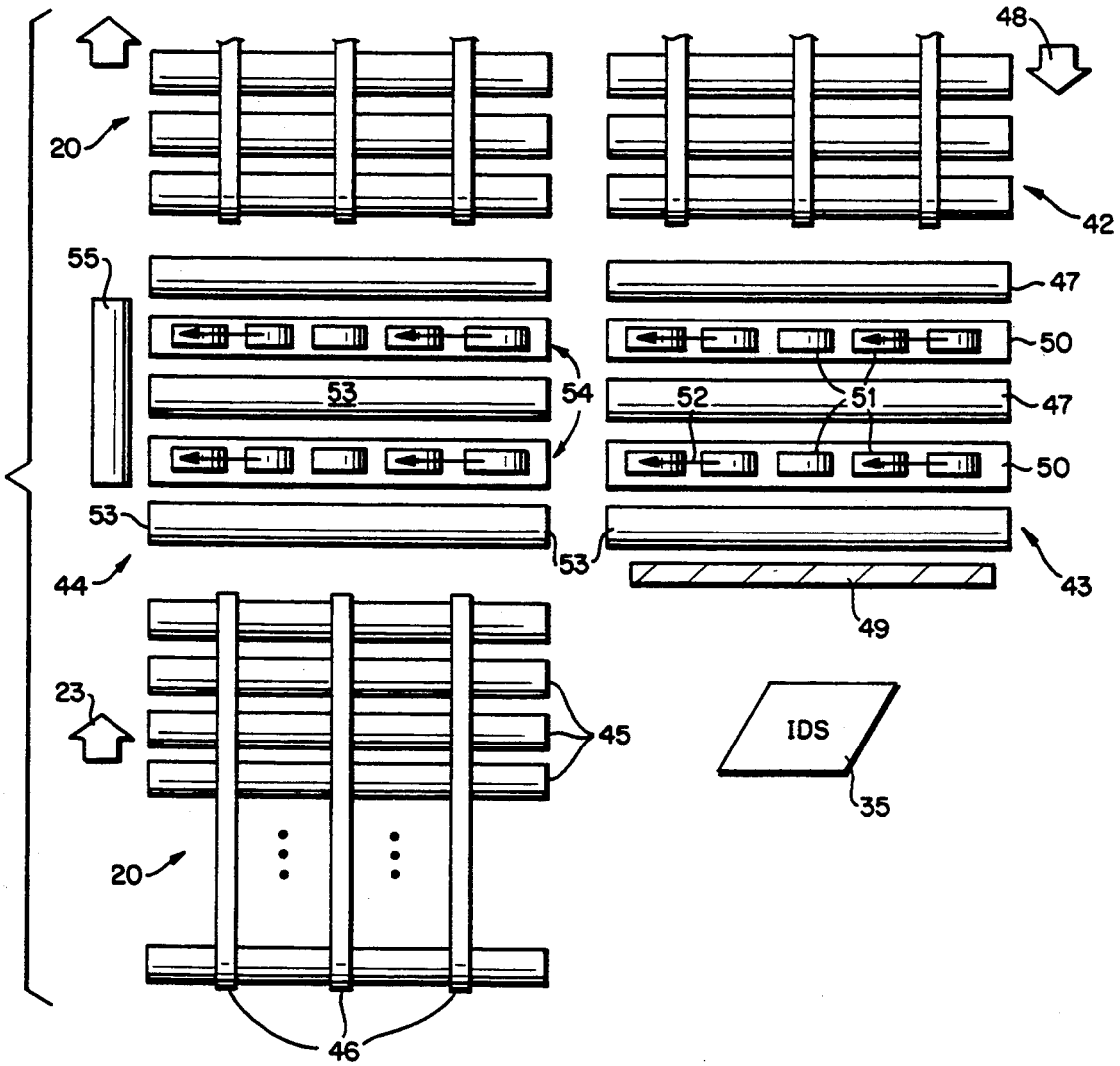
FIG. 5 is a detail top plan view of the apparatus of FIG. 1 at the transfer conveyor between the main conveyor and the second auxiliary loop showing the constructions of the main conveyors and the transfer conveyors.

FIG. 5 is a detailed schematic representation of the various conveyor components at the transfer conveyors 43, 44 in FIG. 1. For example FIG. 5 illustrates the plurality of rotated rollers 45 that are part of the main conveyor 20, having the conveyor belts 46 thereon and transporting the groups of documents in direction 23. The conveyor 42 is of the same type.

The transfer conveyors 43, 44 are conventional. For example the conveyor 43 comprises a plurality of quite widely spaced, powered rollers 47, which convey documents thereon in the direction 48, at least until they engage a stop 49. Between the rollers 47 are the vertically movable roller sets 50, comprising small powered rollers 51 which convey documents in the direction 52 when raised above the level of the rollers 47 by a hydraulic lift or any other suitable mechanism. The transfer conveyor 44 contains a set of rollers 53 like the rollers 50, and the interleaved vertically movable roller sets 54 like the sets 50, the rollers 53 moving documents coming in contact therewith in the direction 23 while the roller sets 54 move in the direction 52, at least up until the stop 55 is engaged. When the scanner 35, or other conventional components, determine that there is a free space on the conveyor 20, and there is a document group on the rollers 47, both of the roller assemblies 50, 54 are moved vertically upwardly above the level of the rollers 47, 53 associated therewith, until the document group is powered by rollers 51, etc. onto the transfer conveyor 44, e.g. in contact with the stop 55, at which time the roller sets 50, 54 are lowered below the tops of the rollers 47, 53, allowing the document group to again be conveyed in the direction 23.

The other transfer conveyors associated with the apparatus of FIG. 1 are similar to the transfer conveyors 43, 44 shown schematically, but in detail, in FIG. 5.

At each filling station 36 are generally horizontal supporting surfaces for supporting a group of documents at a first vertical level. The supporting surfaces preferably take the form of a pair of dump paddles 56, spaced from each other in the direction 23, as indicated by the spacing 57 in FIG. 6, and mounted for rotation about horizontal shafts 58 which are parallel to each other and extend in the direction 52 (perpendicular to the direction 23). The shafts 58 are controlled by motors 59 which operate to either hold the paddles 56 in their horizontal position, supporting a group of documents 60 thereon as seen in solid line in FIG. 6, or moving down to the dotted line position illustrated in FIG. 6 in which case the group of documents 60 falls downwardly below the first level to a second level, into the open top of a container 61. Note in FIG. 6 the document group 60 is shown with plastic shrinkwrap 62 around it.

Additional sensors are associated with each filling station 36 to ensure proper operation. For example, there is a filling station document destination scanner 63 for scanning the bar coding 12 on the banner or manifest page of the document group 60 to ensure that it is dumped into the right container 61. The scanner 63 is a typical bar code reading scanner, e.g. a laser scanner.

The station 36 also has a size scanner 64 for determining the size of the document group 60 at the filling station 36. The size scanner 64 may be a sonic scanner, such as a Sona-Trol® sonic sensor, PW volt series, available from Waddington Electronics of Scranston, R.I.

Figure 6:
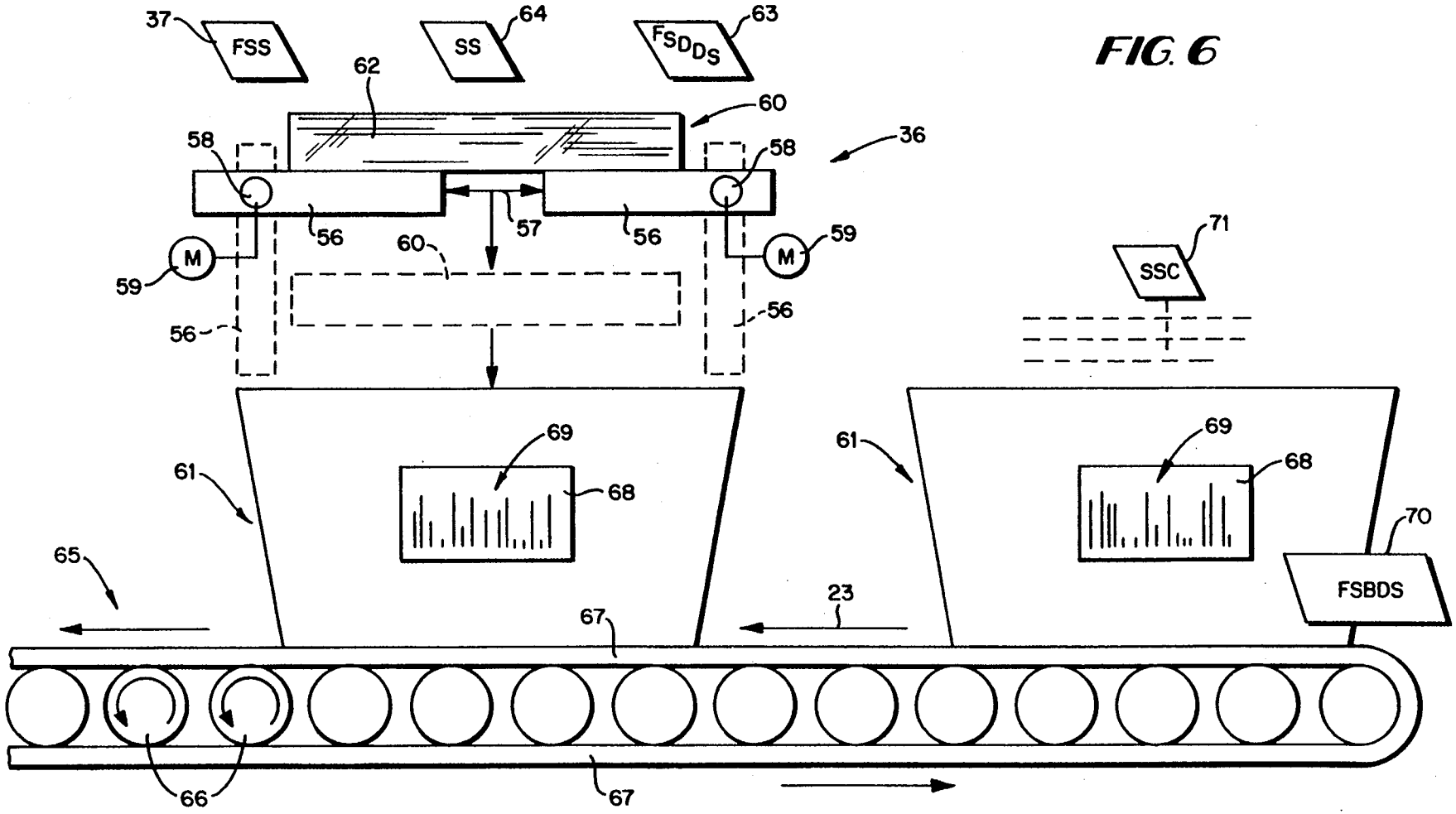
FIG. 6 is a side schematic view of an exemplary filling station of the apparatus of FIG. 1 showing the operation thereof in dotted line.

Disposed below the dump paddles 56 is a main container conveying means 65, seen in FIGS. 1 and 6. The conveying means 65 actually is a complete loop, and preferably comprises a plurality of powered conventional conveyor rollers 66 and with conveyor belts 67 disposed therearound, just like for the main document conveyor 20. Each of the containers 61 being conveyed thereby has a volume that is sufficient to contain more than one group 60 of documents, and is of conventional material, such as hard plastic or cardboard, suitable as a shipping container. It typically has an open top, and a label 68 on one, two, or all sides having bar coding 69 or like machine readable indicia which includes destination indicia corresponding to the destination indicia provided in the bar coding 12. A label 68 with the same bar coding 69 thereon is preferably provided at least on opposite sides of the container 61 to provide maximum flexibility of the operation, and to ensure proper operation even if an operator does not place the container 61 in the correct orientation at the new container supply 73.

Associated with the container conveyor 65 is a filling station box (container) destination scanner 70 comparable to the scanner 63, and a size sensor 71, comparable to the sensor 64. The size sensor 71 determines how much volume is left in the container 61 to receive the next group of documents 60 having the same destination code associated therewith. Typically the containers 61 have a height of about 12.5 inches, and the typical group/stack of documents 60 is no more than 12 inches in height.

When the scanners 63, 70 associated with a particular filling station 36 match the bar coding 12/69 on a group of documents 60 at the station 36, and a container 61 moving in the direction 23 underneath the dump paddles 56, and assuming that the size sensors 64, 71 indicate there is sufficient volume remaining in the container 61 to receive the group of documents 60, motors 59 rotate the shafts 58 to cause the paddles 56 to pivot downwardly, dropping the group 60 into the container 61 as it is continuously conveyed in direction 23. The dump paddles 56 are then automatically returned to the solid line position in FIG. 6 by motors 59.

If no container 61 that has sufficient remaining volume to receive the document group 60 passes to the filling station 36 within a predetermined period of time (typically the time for a container 61 to make a complete loop in the conveyor 65), the group 60 is either dumped into a default container 61 which is circulating with the other destination oriented containers 61, or a signal to a box label printer, shown schematically at 72 in FIG. 4, to print a new label 68 is generated, so that an operator may then affix the label 68 to a new container 61 and enter it into the conveyor loop 65 from the new container supply area 73, connected to the transfer conveyor 74 associated with the conveyor loop 65, by the table/belt conveyor 75.

The decision as to whether or not there is a match between a container 61 at a particular filling station 36 and the document group 60 thereat is preferably made by a decoder located right at the station 36, such a decoder for each of the filling stations 36 being illustrated schematically at 76 in FIG. 4. The decoder 76 may, for example, be model MS-3000 available from Microscan.

As the containers 61 move in the conveyor loop 65, the "fullness" thereof is sensed by the fullness scanner 77, just before the transfer conveyor 78. The scanner 77 may, for example, be a Sona-Trol® sonic sensor, PW volt series, available from Waddington Electronics of Scranston, R.I. If the sensor 77 determines that any particular container 61 is full, it operates the transfer conveyor 78 to move that container 61 off of the container loop 65 onto a roller/belt conveyor 79 (see FIGS. 1 and 2) to a container storage/loading loop 80 (FIG. 2). At the same time the sensor 77 signals the label printer 72 to print a new label 68 having the same destination code as the ejected container 61, or if that order is filled a new destination code, and the new container 61 is added to the container conveyor loop 65 from the supply 73 through the transfer conveyor FIG. 2 illustrates the storage/loading loop 80. Associated with loop 80 is a destination scanner 81, and a transfer conveyor 82. Once a truck 83 arrives to pick up one or more orders for one or more destinations, the particular destinations which the truck 83 will be moving are entered into a computer, such as the PC 15, associated with the scanner 81. The scanner 81 then scans the containers 61 moving in the loop 80 and every time one having a label 68 with the appropriate destination code 69 thereon passes, the transfer conveyor 82 is operated to move that container 61 via the conveyor 84 past the loading scanner 85 to the truck 83. The loading scanner 85 merely confirms what container 61 has been loaded and transmits that data to the PC 15 for storage.

While FIG. 4 shows the various scanners and controls operatively connected to a PC 15, with solid lines indicating data inputs and dotted lines indicating control, it is to be understood that according to the present invention each of the individual modules, such as the stacker 17, the wrapping/banding first auxiliary loop 27, filling station 36, etc. are primarily locally controlled even though there is communication between the modules through the PC 15, and even though data may be transmitted to the PC 15 for storage. Each module 16, 27, 36, etc. has some level of intelligence, so that the system has maximum versatility and adaptability to different circumstances.

Figure 7:
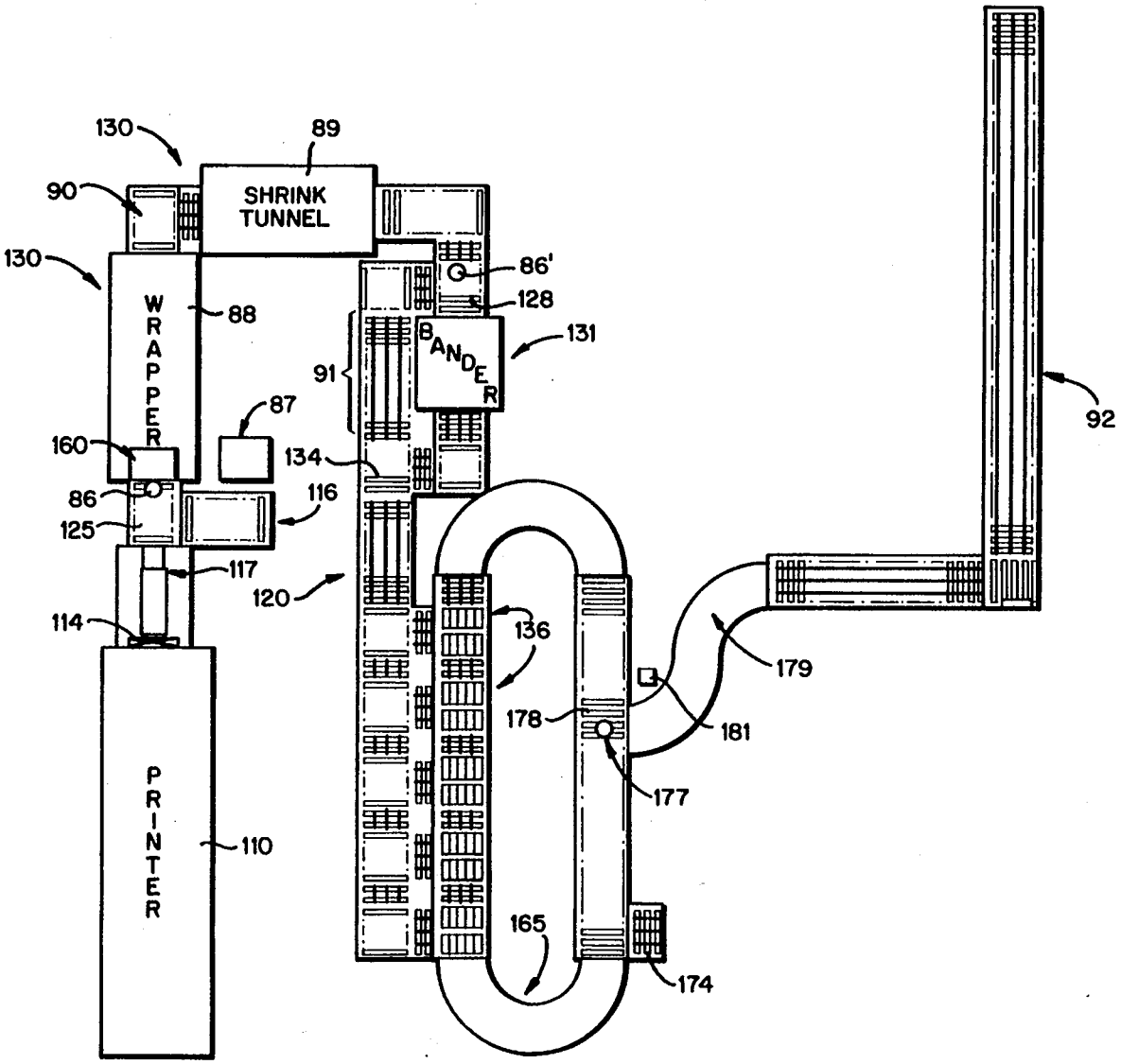
FIG. 7 is a view like that of FIG. 1 for a second exemplary embodiment of apparatus according to the present invention.

FIG. 7 is a schematic representation of another arrangement of components of a system/apparatus according to the present invention which serves to illustrate the adaptability of the system. In FIG. 7 components comparable to those in the FIGS. 1 through 6 embodiments are shown by the same reference numeral only preceded by a "1".

From printer 110, which prints in sheet form, for example, the documents are scanned by verification scanner 114, are gathered by apparatus 117, and are diverted onto default conveyor 116 by transfer conveyor 125 if too large, or has an insufficient number of component parts or type of component parts. Just downstream of the transfer conveyor 125 is a conventional thickness detector 86, such as a Sona-Trol® sonic sensor, PW volt series, available from Waddington Electronics of Scranston, R.I. The thickness detector 86 determines the thickness of the group of documents 160 thereat, and if the thickness is less than a predetermined amount (e.g. one inch), a stiff sheet is put on top or bottom of the stack 160, e.g. a cardboard chip. The cardboard chip is inserted with a conventional chip inserter 87, such as a Sheet Feeder, available from Streamfeeder, Inc. of Minneapolis, Minn.

Downstream of the chip inserter 87 is a conventional plastic shrink wrapper 130, which may include the wrapping module 88 and the shrink tunnel 89, connected by a right angle conveyor 90. After the shrink tunnel 89 the now plastic-wrapped package 160 passes a second thickness detector 86'. If the thickness of the stack 160 is greater than a predetermined amount, e.g. one and one-half inches, it goes to the bander 131 where bands or straps are applied, e.g. along one or both of the length and width of the package. Those stacks 160 below the predetermined thickness sensed by sensor 86' continue along the main conveyor path 120, the transfer conveyors 128, 134 controlling diversion of packages 160 off the main loop 120 to the bander 131, or continuing along the main loop 120.

A plurality of filling stations 136—in this case five of them—are provided associated with the container loop 165. In this embodiment because there are a relatively large number of filling stations 136 serving only one printer 110, there is no reason to provide a loop, such as provided by the conveyor loop system 41 in FIG. 1, but rather when a document package reaches the end of the line 120 it is held there against a stop until the last filling station 136 opens up. The operation of the stations 136, the new container transfer conveyor 174, the full container sensor 177, and the transfer conveyor 178 are the same as for the FIG. 1 embodiment.

Also in this embodiment, the main line 120 may include an accumulator section 91 where the roller/belt conveyors do not operate continuously, but where they can be stopped to accumulate packages. For example if a number of thin packages, e.g. less than one inch thick, are sensed by the detector 86' in rapid sequence (e.g. every six seconds or less a number of packages of twelve pages or less passes by) the conveyor section 91 is shut down to accumulate the packages so as to not overload the filling stations 136.

The conveyor 165 may operate to deliver up to 15 different containers 61 under each filling station 136 every 30 seconds.

In the embodiment of FIG. 7, a storage loop like the loop 80 of FIG. 2 is not provided, but rather the scanner 181 is provided just at the start of the conveyor 179 to update a data base (e.g. in a PC), and to either automatically print a new label or alert an operator by activating an indicator light that a new container should be placed in association with the transfer conveyor 174. The full containers 161 are indexed onto the shipping area conveyor 92 where they are manually removed to be placed in the appropriate truck or other transportation device.

Figure 8:
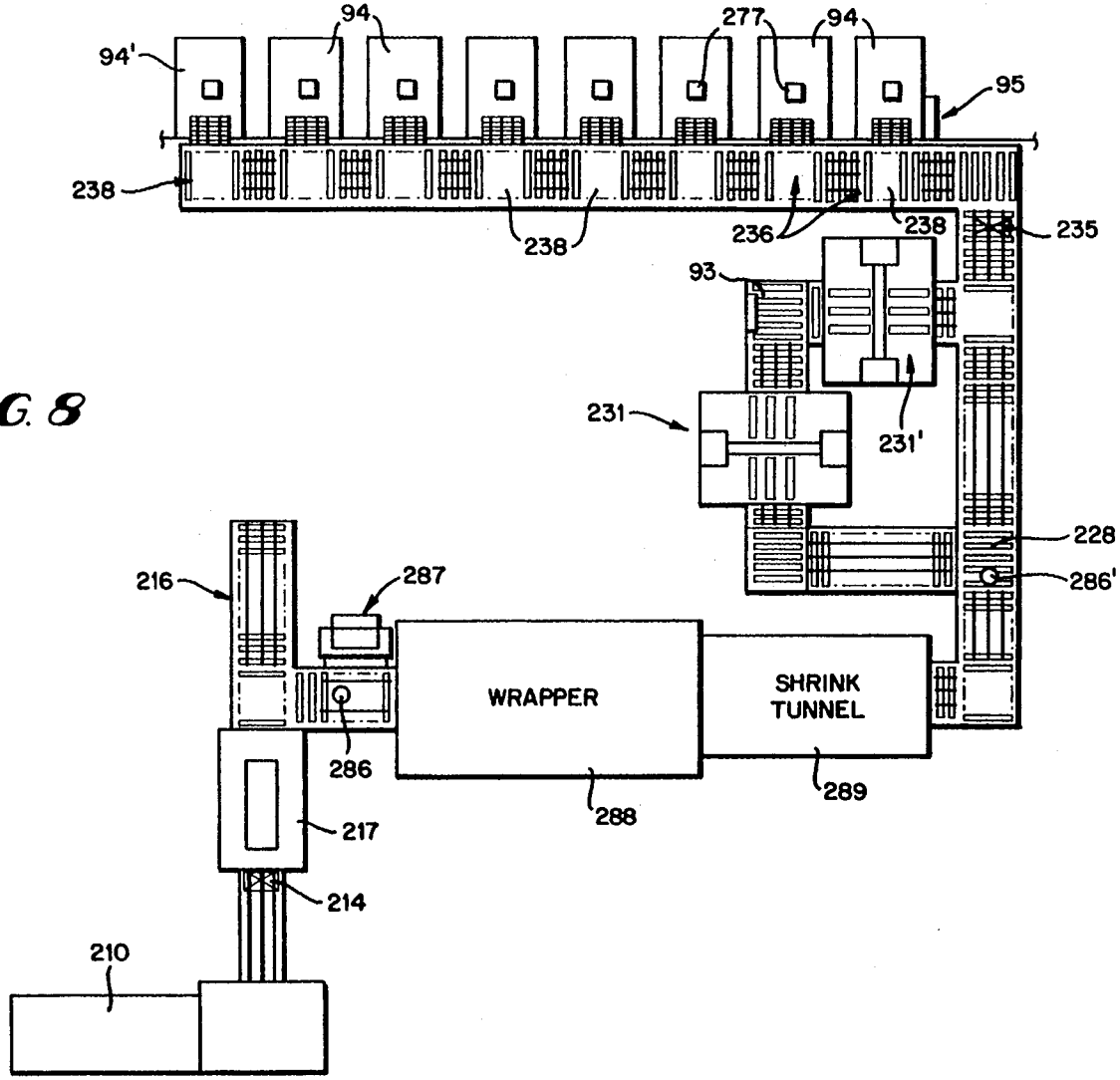
FIG. 8 is a view like that of FIG. 7 of a third embodiment.

FIG. 8 illustrates another exemplary embodiment of the apparatus according to the invention. In FIG. 8 components comparable to those in the FIGS. 1 through 6 or FIG. 7 embodiments are shown by the same two digit reference numeral only preceded by a "2". In the FIG. 8 embodiment only the differences between it and the FIGS. 1 and 7 embodiments will be pointed out, and the individual elements will not be described since they have already been described with respect to the FIGS. 1 and 7 embodiments.

In the FIG. 8 embodiment, two banders 231, 231', connected by a right angle conveyor 93, are provided to ensure wrapping of the packages diverted by transfer conveyor 228 in both directions, not requiring the bander itself to rotate the documents (or only provides bands in one direction), as is true for the bander 131. Also, rather than providing a circulatory loop of moving containers in the FIG. 8 embodiment a large number of filling stations 236 (eight in the drawings) are provided, each having a stationary—while being filled—cart 94 associated therewith. The carts 94 have bar coding—indicated just schematically at 95 in FIG. 8—associated therewith and the scanner 235 controls each of the transfer conveyors 238 associated with the carts 94 so as to deposit a particular group or package of documents into the correct cart 94 by activating the transfer conveyor 238 associated therewith. For any packages that do not correspond to the bar coding 95 associated with one of the carts 94, the transfer conveyor 238 associated with the last cart 94' is activated, and the packages ending up in cart 94' are sorted manually.

When a full signal is generated for a cart 94, as sensed by a sensor 277 disposed over that cart, an alarm is activated advising the operator that the cart 94 is to be replaced with another cart, which is wheeled into place once the full cart 94 has been wheeled out of place and to a shipping area.

It will thus be seen that according to the present invention an advantageous method and apparatus for handling groups of printed documents has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of automatically creating and sorting document groups for automatic delivery to a plurality of different destinations, utilizing a plurality of reusable containers with machine readable destination codes, comprising the steps of substantially continuously and automatically:

(a) automatically creating a plurality of different groups of documents, each group having from one to many documents;

(b) automatically creating machine readable indicia for association with each of said groups of documents, the indicia including at least destination indicia;

(c) automatically associating the machine readable indicia with each group of documents;

(d) automatically diverting one of the groups of documents to a first filling station;

(e) automatically sensing the machine readable destination indicia associated with the group of documents at the first filling station;

(f) automatically passing the plurality of reusable containers with machine readable destination codes past the first filling station;

(g) automatically sensing the machine readable destination codes of the reusable containers moving past the first filling station;

(h) when the sensed destination indicia of a group of documents at the first filling station matches the destination code of a container passing past the first filling station, automatically transferring the group of documents from the first filling station to the matched reusable container; and (i) emptying filled containers and reusing the containers in the practice of steps (g)–(h).

2. A method as recited in claim 1 comprising the further step (i) of determining the size of the group of documents at the first filling station and the volume remaining in the matched container, and wherein step (h) is practiced only if the determination from step (j) indicates sufficient remaining volume in the matched container to receive the group of documents at the first filling station.

3. A method as recited in claim 2 comprising the further step (k) of providing for passage in step (f) of a new matched container for the group of documents at the first filling station if it is determined in step (j) that the matched container has insufficient volume remaining.

4. A method as recited in claim 1 wherein a plurality of different filling stations are provided, and wherein (f) is practiced to continuously recirculate the containers past all of the filling stations, and comprising the further steps of sensing the availability of each filling station to receive a group of documents, and practicing step (d) for each filling station in response to that sensing.

5. A method as recited in claim 1 comprising the further step (j) of, between steps (c) and (d), acting on the group of documents to maintain them in an integral bundle during further processing.

6. A method as recited in claim 5 wherein step (j) is practiced by wrapping the group of documents into a bundle.

7. A method as recited in claim 6 wherein said wrapping step is accomplished by plastic shrink wrapping.

8. A method as recited in claim 6 comprising the further step of (k) banding the bundle.

9. A method as recited in claim 6 comprising the further steps of (k) sensing the thickness of the group of documents before step (j), and (l) if the sensed thickness is less than a predetermined amount, providing a stiff sheet on the group of documents prior to step (j).

10. A method as recited in claim 6 comprising the further steps of (k) sensing the thickness of the bundles after the practice of step (j), and (l) if the sensed thickness of the bundle is greater than a predetermined amount, banding the bundle.

11. A method as recited in claim 4 wherein step (f) is practiced by moving the containers on a conveyor, and wherein the filling stations are located above the containers and conveyor; and wherein step (h) is practiced by dropping the groups of documents from the filling stations into the conveyors.

12. A method as recited in claim 4 comprising the further steps of (j) continuously sensing the degree of fullness of the containers passing in step (f), and (k) when a container is sensed in step (j) to have a predetermined degree of fullness, diverting the container to a full container location so that the full container no longer is recirculated past the filling stations.

13. A method as recited in claim 1 comprising the further steps, between steps (c) and (d), of (j) verifying that each group of documents is a proper group of documents, and (k) if in response to step (j) it is determined that the group is not a proper group, diverting the improper group to an improper group location so that it does not pass to step (d).

14. A method as recited in claim 13 wherein step (j) is practiced to verify that the appropriate number and type of documents are in the group, and to verify that the group does not contain more than a predetermined number of documents.

15. A method as recited in claim 12 comprising the further steps of (l) at the full container location sensing the destination codes associated with the containers, and (m) in response to step (l) delivering containers with selected destination codes to the appropriate destinations corresponding to those codes.

16. A method as recited in claim 1 wherein step (b) is practiced by printing a sheet of paper associated with each group of documents with a bar code; and wherein the machine readable codes associated with each container are also bar codes.

17. A method as recited in claim 1 comprising the further steps of (j) automatically sensing the absence or presence of a group of documents at the first filling station, practicing step (d) if no other group of documents is sensed at the first filling station, and (k) if step (j) senses another group of documents at the first filling station, causing the groups of documents to move past the first filling station in a closed loop path until the first filling station is open as sensed during the practice of step (j).

18. A method as recited in claim 17 wherein a plurality of different filling stations are provided, and wherein step (f) is practiced to continuously recirculate the containers past all of the filling stations, and comprising the further steps of sensing the availability of each filling station to receive a group of documents, and practicing step (d) for each filling station in response to that sensing.

19. A method of routing a plurality of stacks of documents to desired destinations, at least two groups of documents being routed to each of at least two different destinations, utilizing open top reusable containers, comprising the steps of:

(a) providing a paper sheet having bar coding thereon with destination indicia at at least the top or the bottom of each of the plurality of stacks of documents;

(b) automatically sensing the destination bar coding on each stack of documents;

(c) automatically sensing destination bar coding associated with an open top reusable container large enough to receive a plurality of stacks of documents;

(d) automatically in response to steps (b) and (c), depositing a plurality of stacks of documents having the same destination bar coding in a matched bar code container through the open top thereof; and (e) emptying full containers and reusing them in the practice of steps (c) and (d).

20. A method as recited in claim 19 comprising the further steps of (f) automatically sensing when each container has more than a predetermined amount of documents therein so that the remaining volume in the container is less than the size of the next expected stack of documents, indicating that the container is full, and (g) automatically replacing the full container with an emptier container having the same destination bar coding.

21. A method as recited in claim 20 comprising the further step of (h) substantially continuously moving the stacks of documents and containers while practicing steps (b) and (c), to allow random matching of the stacks with the containers.

22. A method as recited in claim 21 comprising the further step (l), prior to step (d), of acting on the stack of documents so that it maintains its integrity during the practice of steps (a)–(d), and so that at least a plurality of the stacks can be easily removed from the container, distinctly from the other stacks in the container.

23. A method as recited in claim 22 wherein step (i) is practiced by banding, plastic shrink wrapping, or plastic shrink wrapping and then banding, at least some stacks.

24. A method as recited in claim 23 wherein step (a) is practiced to provide handling bar code indicia on the paper sheet with the destination bar code indicia, and comprising the further steps of (j) automatically sensing the handling bar code indicia on the paper sheet, and (k) practicing step (l) in response to step (i).

25. Apparatus for handling stacks of documents, comprising:

a plurality of transport conveyors for conveying documents in stacks thereon, and disposed in at least one continuous loop configuration so that there are intersections between at least some of said transport conveyors;

a plurality of transfer conveyors located at the intersections between the transport conveyors for selectively transferring stacks of documents from one transport conveyor to an intersecting transport conveyor;

first automatic sensing means for sensing the stacks of documents, and in response to the sensing selectively controlling said transfer conveyors;

a plurality of open top reusable containers;

container conveying means for conveying said plurality of open top reusable containers to receive said stacks of documents;

automatic conveyor filling means disposed over said container conveying means for depositing selected stacks of documents from said transport conveyors through the open tops of selected containers; and second automatic sensing means for sensing said containers, and in response to sensing said containers and in response to said first automatic sensing means, selectively operating said filling means to deposit selected stacks of documents into selected containers through the open tops thereof.

26. Apparatus as recited in claim 25 wherein said automatic filling means comprises: a movable document support surface at a first vertical level, disposed over said container conveying means which are at a second vertical level, below said first level a distance corresponding to at least the height of a said container; and means for controlling said movable document support surface to effect movement thereof so that it no longer supports a stack of documents so that the stack of documents drops into a said container through the open top thereof.

27. Apparatus as recited in claim 26 wherein said automatic filling means comprises a pair of dump paddles each separately mounted for rotation about an axis parallel to and horizontally spaced from the axis of the other of said dump paddles.

28. Apparatus as recited in claim 27 wherein a plurality of said filling means are provided, each comprising a pair of dump paddles and independent control means for operating said dump paddles.

29. Apparatus as recited in claim 25 wherein said transport conveyors each comprise a plurality of driven rollers parallel to each other and located adjacent one another and rotatable about an axis substantially perpendicular to the direction of conveyance of said rollers, and a plurality of endless conveyor belts disposed over said rollers and elongated in the direction of conveyance.

30. Apparatus as recited in claim 25 further comprising means for acting on said stacks of documents for placing them in integral bundles, and third automatic sensing means for sensing which bundles will be acted upon in what particular manners for placing them in integral bundles.

31. Apparatus as recited in claim 30 wherein said acting means comprise plastic shrink wrapping means.

32. Apparatus as recited in claim 31 wherein said third sensing means includes means for sensing the thickness of a stack to be acted upon, and depending upon the thickness, selectively placing a stiff sheet into contact with the top or bottom of the stack.

33. Apparatus as recited in claim 31 wherein said acting means further comprises means for banding a shrink-wrapped bundle.

34. Apparatus as recited in claim 33 wherein said third sensing means includes means for sensing the thickness of a shrink-wrapped bundle, and means for selectively directing the bundle to said banding means depending upon the sensed thickness.

35. Apparatus as recited in claim 25 further comprising third automatic sensing means for sensing when a container is full; means for automatically removing a full container, including a transfer conveyor associated with said container conveyor means; and means for providing a new, emptier container to said container conveying means when a full container is removed.

36. Apparatus as recited in claim 25 further comprising size and volume sensing means for sensing the relative size of a stack of documents compared to the remaining volume in a conveyor, and selectively operating said filling means to deposit a stack of documents in a container only if said size and volume sensing means determines that there is sufficient volume remaining in the container to receive the stack of documents.

37. Apparatus as recited in claim 25 wherein each stack of documents and each container has destination bar coding associated therewith; and wherein said first and second automatic sensing means each comprise bar code sensing means.

38. Apparatus as recited in claim 37 further comprising third automatic sensing means for sensing when a container is full; means for automatically removing a full container, including a transfer conveyor associated with said container conveyor means; and means for providing a new, emptier container to said container conveying means when a full container is removed.

39. Apparatus as recited in claim 38 further comprising means for generating a bar code label with the same destination bar coding thereon as the removed full container so that the label can be applied to the new, emptier container which replaces the full container.

40. Apparatus as recited in claim 25 further comprising means for printing, folding, and severing continuous business forms to produce said stacks of documents.

41. Apparatus for automatically handling groups of documents wherein each group of documents has destination coding associated therewith, comprising:

means for printing a plurality of documents;

means for grouping the printed documents into a plurality of different groups;

first conveying means for conveying grouped documents away from said printing means;

means for verifying the correctness of the groups of documents;

a special document group location;

means for selectively diverting groups of documents from said first conveying means to said special document group location in response to said verifying means;

means for selectively acting on the groups of documents conveyed by said first conveying means to maintain the integrity of the groups in bundles; and second conveying means for conveying a plurality of open top containers in a closed loop path, each said container having a volume great enough to receive a plurality of groups of documents therein and destination coding associated therewith; means for automatically sensing the groups of documents and the containers; and filling means for depositing groups of documents with first destination coding in containers having matching destination coding.

42. Apparatus as recited in claim 41 further comprising first means for automatically sensing the thickness of documents conveyed by said first conveying means, and means for selectively placing a stiff support sheet on a group of documents if said first sensing means senses a thickness below a predetermined amount.

43. Apparatus as recited in claim 42 wherein said selectively acting means comprises plastic shrink wrap means.

44. Apparatus as recited in claim 43 further comprising second means for automatically sensing the thickness of documents that have been plastic shrink wrapped into bundles, and means for selectively banding said plastic shrink-wrapped bundles if said second thickness sensing means senses a thickness over a predetermined amount.

45. Apparatus for handling groups of documents, comprising:

first linear document conveying means for conveying documents in a first predetermined path;

first auxiliary document conveyor means connected to said first linear conveying means by transfer conveyors, and defining a closed loop beginning and ending in said first linear conveying means;

second auxiliary document conveyor means connected to said first linear conveying downstream of said first auxiliary conveyor means in said first path, and defining a closed loop beginning and ending in said first linear conveying means;

first container filling means connected to said first linear conveyor means by a transfer conveyor;

first container conveying means defining a conveying loop path beneath said filling means; and automatic sensing means for sensing documents at said first container filling means and a container beneath said first container filling means and selectively operating said first container filling means to deposit documents from said filling means into a container on said first container conveying means.

46. Apparatus as recited in claim 45 wherein said automatic sensing means includes means for sensing the size of the group of documents at said first container filling means, and means for determining the remaining volume in a container beneath said first filling means.

47. Apparatus as recited in claim 46 further comprising a plurality of container filling means disposed above said first container conveying means.

48. Apparatus as recited in clam 45 further comprising second sensing means for sensing documents on said first linear document conveying means upstream of said fist auxiliary conveying means, and for selectively passing said documents to said first auxiliary conveying means.

49. Apparatus as recited in claim 45 further comprising a second container conveying means remote from said filing means, and a transfer conveyor connecting said first and second container conveying means, and second automatic sensing means for sensing the fullness of containers on said first container conveying means and selectively controlling said transfer conveyor between said first and second container conveyor means.

50. Apparatus as recited in claim 49 further comprising second automatic sensing means for sensing when a group of documents is at said first filling station, and for selectively passing a group of documents to said first filling station from said first document linear conveying means if said filling station is unoccupied.

51. Apparatus for handling stacks of documents, comprising:

a plurality of individual modules, each module having intelligence associated therewith, and self-contained control means associated therewith;

document conveying means extending between said modules and for moving documents into association with, or into and out of association with, the modules;

a plurality of sensing means for sensing the position, type, or size of stacks of documents being conveyed by said conveying means, at lease one sensing means associated with each of said modules;

a plurality of open top containers each for containing a plurality of stacks of documents for a common destination;

container conveying means for conveying said containers in a closed loop; and wherein one of said modules comprises a container filling module located above said container conveying means for selectively dropping a stack of documents therefrom into a said container.

* * * * *